United States Patent [19]

Schulz

[11] 4,371,129

[45] Feb. 1, 1983

[54] BOBBIN FOR USE IN PRODUCING A MESOPHASE PITCH DERIVED CARBON YARN

[75] Inventor: David A. Schulz, Fairview Park, Ohio

[73] Assignee: Union Carbide Corporation, Danbury, Conn.

[21] Appl. No.: 217,439

[22] Filed: Dec. 17, 1980

[51] Int. Cl.[3] ..... B65H 75/12; B65H 75/14

[52] U.S. Cl. ..... 242/118.7; 242/118.32

[58] Field of Search ..... 242/118.32, 118.3, 118.31, 242/118.7, 118.8; 264/51–54

[56] References Cited

U.S. PATENT DOCUMENTS

| | | | |
|---|---|---|---|
| 2,756,006 | 7/1956 | Klein | 242/118.32 |
| 3,107,152 | 10/1963 | Ford et al. | 23/209.2 |
| 3,270,980 | 9/1966 | Philips | 242/118.7 |
| 3,398,915 | 8/1968 | Dittrich | 242/118.7 |
| 3,503,708 | 3/1970 | Spry | 23/209.2 |
| 3,643,888 | 2/1972 | Blue | 242/118.32 |
| 3,993,265 | 11/1976 | Parks | 242/118.32 |

*Primary Examiner*—Leonard D. Christian

*Attorney, Agent, or Firm*—David Fink

[57] ABSTRACT

A bobbin capable of retaining thermoset yarn during a heat treatment to pyrolyze and carbonize the thermoset yarn to produce a good quality carbon yarn, comprises a cylindrical body made of selected materials; and a layer of carbon felt positioned on the outside surface of the cylindrical body to receive the thermoset yarn and to minimize stress between the cylindrical body and the thermoset yarn during the heat treatment.

5 Claims, 5 Drawing Figures

PRIOR ART

BOBBIN FOR USE IN PRODUCING A MESOPHASE PITCH DERIVED CARBON YARN

The invention relates to a carbon yarn, and particularly to a bobbin for use in producing a mesophase pitch derived carbon yarn.

Generally, the conventional commercial process for producing a mesophase pitch derived carbon yarn includes the steps of forming a plurality of mesophase pitch fibers to define a mesophase pitch yarn, thermosetting the mesophase pitch yarn to produce a thermoset yarn, and thereafter subjecting the thermoset yarn to a thread-line heat treatment in an inert atmosphere to pyrolyze and carbonize the thermoset yarn and produce the carbon yarn.

U.S. Pat. No. 3,503,708 to Spry describes a known process for producing carbon yarn.

According to prior art practices and teachings, the heat treatment step is carried out with the thermoset yarn extending linearly and subjected to tension. The tension has been found in the prior art to be necessary to obtain good mechanical properties such as tensile strength and Young's modulus in the yarn, and to avoid kinks and other surface defects of the fibers in the yarn.

The presence of surface defects in the carbon fibers of the carbon yarn adversely affect subsequent steps leading to the commercial use of the carbon yarn. For example, a typical manufacturing operation carried out on carbon yarn is the use of a finishing material on the carbon yarn. Surface defects and broken fibers in the carbon yarn tend to result in the carbon yarn retaining relatively large amounts of the finishing material. This makes it difficult to dry and wind the yarn onto a bobbin.

In addition, major commercial uses require the carbon yarn to be incorporated into a composite structure with a resin and the surface defects and broken fibers tend to cause the carbon yarn to retain excessive amounts of the resin used. This is undesirable.

Commercial economics have motivated efforts to increase the rate of production of carbon yarn. These efforts have resulted in attempts to reduce the time needed for pyrolysis by increasing the rate of movement of the thermoset yarn during the pyrolysis. It has now been found that when a certain speed is exceeded the occurrence of breaks in the fibers in the thermoset yarn is drastically increased. Thus, this represents a serious obstacle to high production rates according to the prior art methods.

A careful and extensive analysis of the possible causes of the breakage of thermoset yarns during pyrolysis has resulted in the discovery that the load-bearing capacity of thermoset mesophase pitch yarn reduces considerably during pyrolysis. In particular, it has been found that the thread-line breaking strength for a thermoset mesophase pitch yarn declines from its values at room temperature to about one-fourth of this value as the temperature of the yarn in an inert atmosphere is raised until a temperature of from about 700° C. to about 800° C. is reached. At higher temperatures, the breaking strength of the yarn increases.

The discovery of this phenomena manifests a serious limitation on production rates according to prior art practices.

Experiments were carried out in an endeavor to avoid the aforementioned problem of reduced thread-line breaking strength at the elevated temperatures by collecting the thermoset mesophase pitch yarn onto a bobbin and subsequently pyrolyzing and carbonizing the pitch yarn on the bobbin. The carbon yarns obtained had broken fibers and surface defects and were not deemed satisfactory. Moreover, the bobbins used usually became damaged as a result of this heat treatment because of the force arising from the contraction of the thermoset yarn. Among the bobbins tested was a bobbin made of fine grain graphite. This was used in order to have the bobbin compatible with the yarn at the elevated temperatures.

Even a coreless package of the thermoset mesophase pitch yarn was used in the experiments in order to attempt to avoid problems which arose because of the use of a bobbin. Nevertheless, the coreless package produced unsatisfactory carbon yarn having surface defects.

The instant invention overcomes the problems of the prior art and provides numerous surprising advantages.

The invention allows higher manufacturing rates than are possible according to prior art methods at lower costs and with fewer problems. Less effort by production workers is needed for the instant heat treatment and there is a more efficient use of energy for the invention as compared to the prior art methods.

Even more surprising is that the invention permits the production of exceptionally good carbon yarn as compared to the prior art methods, and the invention enables a good control on the mechanical properties of the carbon yarn.

Among the numerous advantages is the longer operating life for the thread-line furnace used for one embodiment of the instant invention and a more stable furnace operation.

As used herein, the term "pitch" is a carbonaceous residue consisting of a complex mixture of primarily aromatic organic compounds derived from the thermal treatment of organic materials. Pitch is solid at room temperature and exhibits a broad melting or softening temperature range. When cooled from the melt, pitch becomes solidified without crystallization.

As used herein, the term "mesophase" is synonomous with liquid crystal; i.e. a state of matter which is intermediate between a crystal and an isotropic liquid. Ordinarily, material in this state exhibits both anisotropic and the liquid properties.

Pitches can contain varying amounts of mesophase. The mesophase regions in the pitch are recognized by the optical anisotropy in the liquid state and the anisotropy is maintained in the solid state.

As used herein, the term "mesophase pitch" is a pitch containing at least about 40% by weight mesophase. This is the minimum level for which a pitch is capable of forming a continuous anisotropic phase when dispersed by agitation or similar means.

Preferably, the invention is carried out using mesophase pitch having at least about 70% by weight mesophase.

The term "yarn" as used in the art describes a plurality of fibers. Generally, the number of fibers is at least about 1000 and usually about 2000. The number of fibers can be 5000 or more.

The terms "mesophase pitch yarn" and "pitch yarn" are used herein to identify the plurality of mesophase pitch fibers or "as-spun" fibers which define a yarn.

The term "thermoset yarn" is used herein to identify the pitch yarn which has been subjected to a thermosettting treatment.

The terms "pyrolyzed yarn" and "carbon yarn" are used herein respectively to identify the thermoset yarn which has been pyrolyzed and carbonized.

The term "winding angle" is used herein in connection with the operation of winding thermoset yarn onto a bobbin. In accordance with prior art usage this term refers to the angle defined by the portion of the yarn being wound onto the bobbin and a plane perpendicular to the axis of the bobbin.

The instant invention is primarily directed to mesophase pitch derived carbon yarn having an average Young's modulus of at least about $10\times10^6$ psi for the individual carbon fibers in the carbon yarn.

The invention relates to a bobbin for use in a method for producing a mesophase pitch derived carbon yarn and the method features the steps of forming a plurality of mesophase pitch fibers to define a mesophase pitch yarn; thermosetting the mesophase pitch yarn to produce a thermoset yarn; winding the thermoset yarn onto the bobbin which is thermally and mechanically stable at the temperatures used to pyrolyze and carbonize the thermoset yarn and which is chemically compatible with the thermoset yarn at stages of transition of the thermoset yarn; and subjecting the thermoset yarn on the bobbin to a predetermined heat treatment in an inert atmosphere to pyrolyze and carbonize the thermoset yarn.

Preferably, the mesophase pitch has a mesophase content of at least about 70% by weight.

In its broadest embodiment, the invention relates to a bobbin capable of retaining thermoset yarn during the heat treatment to pyrolyze and carbonize the thermoset yarn to produce a good quality carbon yarn. The bobbin comprises a cylindrical body made of a material selected from the group consisting of stainless steel, refractory oxides, boron nitride, and graphite; and a layer of compressible resilient carbon material such as carbon felt positioned on the outside surface of the cylindrical body to receive the thermoset yarn and minimize stress between the cylindrical body and the thermoset yarn during the heat treatment.

One embodiment of the bobbin further includes end faces connected to respective end portions of the cylindrical body in order to retain the thermoset yarn on the bobbin, particularly for a parallel winding of the thermoset yarn on the bobbin.

Typically, the cylindrical body of the bobbin can have an inside diameter of about 3 inches and an outside diameter of 3½ inches with a length of about 11 inches.

Preferably, the carbon felt has a thickness of from about ¼ inch to about ½ inch thick.

Generally, the mesophase pitch yarn comprises at least about 1000 mesophase pitch fibers and typically about 2000 mesophase pitch fibers. The number of mesophase pitch fibers in the mesophase pitch yarn can be even higher.

The instant invention is particularly significant in connection with commercial production of mesophase pitch derived carbon yarn having about 2000 fibers. The handling of the yarn and the difficulties in maintaining acceptable qualities is demanding.

Generally, the tension on the thermoset yarn during the winding step is from about 75 g. to about 300 g. and preferably from about 150 g. to about 200 g.

The control over the amount of tension in the thermoset yarn as it is wound on the bobbin is important. If the tension is too low, the resulting loosely wound bobbin is difficult to handle in the manufacturing operations, and the fibers in the yarn do not develop the straightness required for good mechanical properties. If the tension is too high, the fibers near the core of the bobbin become distorted as well as other problems develop.

One method using the instant bobbin includes a heat treatment carried out by increasing the temperature from about 50° C. to about 100° C. per hour until the temperature is about 1300° C. for from about one to two hours. A similar thread-line heat treatment is known. This heat treatment will be referred to as in the art, as a "precarb" or "precarbonizing" although carbonizing actually takes place. The carbon yarn obtained from this treatment possesses many characteristics which make it suitable for a range of commercial uses. If, however, improved mechanical properties such as tensile strength and Young's modulus are desired, then a thread-line treatment as used in the prior art is carried out by unwinding the yarn and sending it through the thread-line treatment at a temperature of about 2500° C. Surprisingly, this thread-line treatment can be carried out using relatively high tension with very few of the fibers breaking.

The use of the instant bobbin allows the precarbonizing treatment to be followed by a thread-line treatment using generally higher tensions than the tension used according to the prior art methods. The use of higher tensions during the thread-line treatment generally results in carbon yarn having Young's modulus from 10% to 40% higher than the carbon yarn subjected to the same temperature treatment according to the prior art.

The use of a precarbonizing treatment has several other advantages. During this treatment, the thermoset yarn goes through well known stages of transition as gasses are driven out of the fibers. These gasses can be corrosive and highly reactive so that the heating units must be designed to resist these gasses. To some extent, the tendency for the gasses to be reactive at 1300° C. is less than typically higher pyrolyzing and carbonizing temperatures such as 2500° C.

Thus, the two step pyrolysis and carbonizing operation allows the second heating unit to be less resistant to attack so that the second heating unit can be a less expensive unit and the unit used generally has a longer useful operating life.

Typically, mesophase pitch yarn is thermoset by subjecting it to a temperature of from about 200° C. to about 400° C. in air or some other oxidizing atmosphere. The winding of the thermoset yarn onto a bobbin can be carried out using a range of winding angles. It has been found that a relatively wide range of angles of from about 15° to about 30° can be used in connection with a bobbin having no end faces for the aforementioned precarb treatment which uses a maximum temperature of about 1300° C. A zero degree or parallel winding should be used with a bobbin having end faces in order to avoid having the yarn fall off the bobbin at the ends. The bobbin having parallel windings can be heat treated to about 3000° C. to produce good quality yarn having a strength of more than about $400\times10^3$ psi and a Young's modulus of greater than about $100\times10^6$ psi.

The instant invention is particularly directed to carbon yarn having at least 2000 carbon fibers because of the commercial problems which are overcome and avoided.

Further objects and advantages of the invention will be set forth in part in the following specification and in part will be obvious therefrom without being specifically referred to, the same being realized and attained as pointed out in the claims hereof.

For a fuller understanding of the nature and objects of the invention, reference should be had to the following detailed description, taken into connection with the accompanying drawings, in which.

In carrying the invention into effect, certain embodiments have been selected for illustration in the accompanying drawings and for description in the specification. Reference is had to FIGS. 1 to 4.

Figure 1:
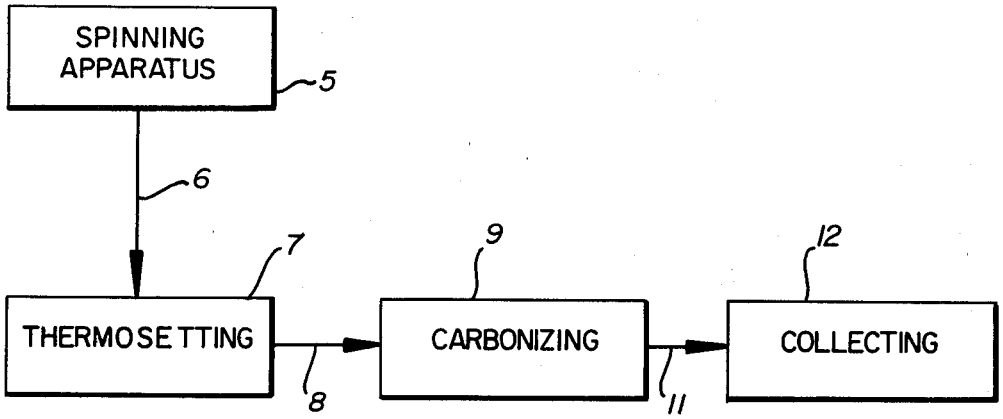
FIG. 1 is a simplified block diagram of the commercial operations for producing carbon yarn.

FIG. 1 shows the principal steps in the commercial production of carbon yarn from mesophase pitch. Spinning apparatus 5 is used to spin 2000 mesophase pitch fibers with each fiber having a diameter of about 13 microns. The mesophase pitch fibers form a mesophase pitch yarn 6 which enters the thermosetting unit 7. Thermoset yarn 8 is produced by the thermosetting unit 7 and is moved to pyrolyzing and carbonizing unit 9 for a heat treatment to produce carbon yarn 11 which is wound up on rolls in collection unit 12. Typically, winding and unwinding operations onto and off of a cardboard bobbin are carried out for the thermoset yarn 8 between the units 7 and 9.

Attempts to move the thermoset yarn 8 through the unit 9 at relatively high rates have resulted in load fluctuations on the thermoset yarn 8 and this in turn has produced poor quality carbon yarn 11.

Figure 2:
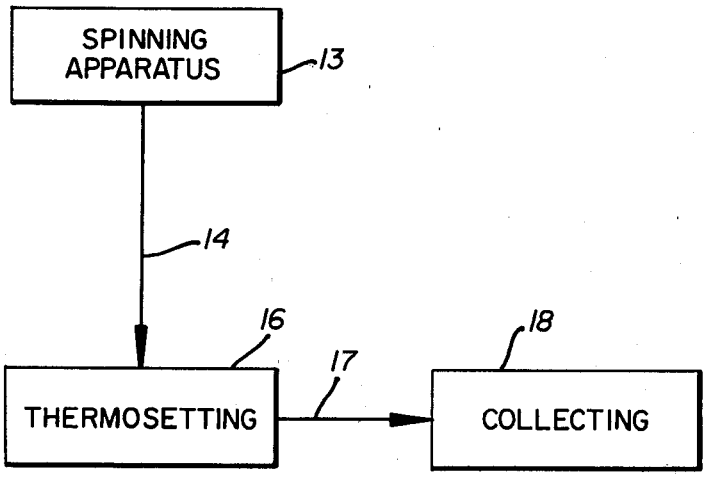
FIG. 2 shows a block diagram of some of the steps of a method using the instant invention.

FIG. 2 shows a spinning apparatus 13 which produces 2000 mesophase pitch fibers to define a mesophase pitch yarn 14. The mesophase pitch yarn 14 enters thermosetting unit 16 which produces thermoset yarn 17. Collecting unit 18 collects the thermoset yarn 17 onto a bobbin of the invention.

Figure 3A:
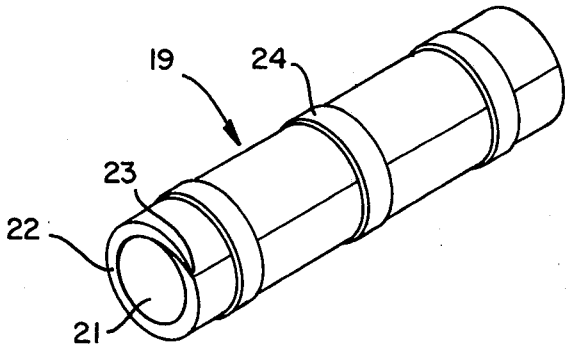
FIGS. 3A and 3B show two embodiments of the instant bobbins.
Figure 3B:
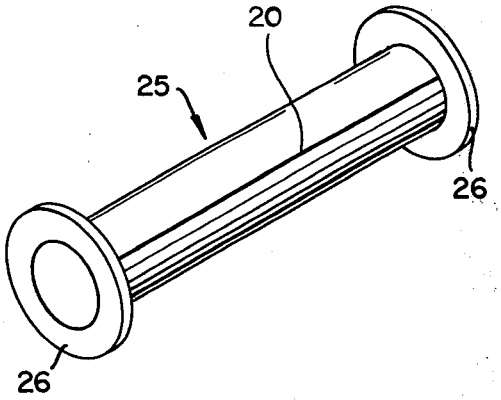

FIGS. 3A and 3B showed two embodiments of the instant bobbins suitable for carrying out the method described herein. Bobbin 19 includes a body 21 and a carbon felt material 22 having a bias cut 23 wrapped around the body 21 and to provide a smooth and continuous joint. The carbon felt material 22 can be attached to the body 21 with an adhesive or even "masking" tape 24. The tape 24 at the high temperatures carbonizes and is only used to temporarily hold the carbon felt material 22 in place until the thermoset yarn is wrapped onto the bobbin 19.

Typically, the inside diameter of the body 21 is about 3 inch and the length of the body 21 is about 11 inch. The carbon felt material 22 has a thickness of about ¼ inch.

FIG. 3B shows a bobbin 25 which can also be used in connection with the instant invention. A carbon felt material 20 having a smooth and continuous joint is provided to receive the thermoset yarn to be wrapped on the bobbin 25. Bobbin 25 differs from bobbin 19 in that it has end plates 26. The bobbin 25 allows a zero angle or parallel winding of thermoset yarn without encountering the problem of the yarn falling off at the ends of the bobbin 24.

Figure 4:
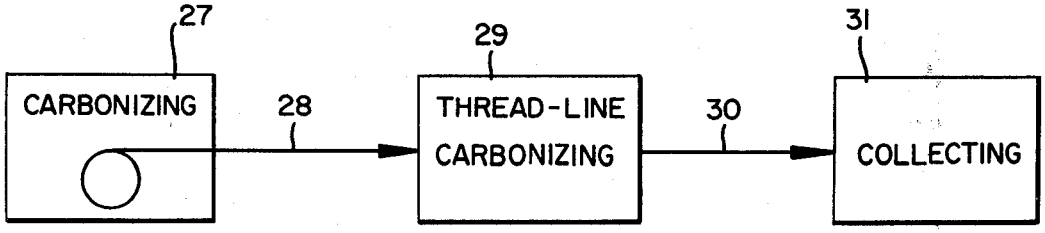
FIG. 4 shows a simplified block diagram of steps subsequent to the steps shown in FIG. 2.

In FIG. 4, a bobbin containing thermoset yarn is subjected to a heat treatment in pyrolyzing and carbonizing unit 24. For some commercial uses, no further heat treatment is needed. Other commercial uses require that pyrolyzed yarn 28 be subjected to a thread-line treatment at about 2400° C. in carbonizing unit 29. This produces carbon yarn 30 which is moved to collecting unit 31 which winds the carbon yarn 30 onto another bobbin for storage and handling.

In the examples herein, the bobbins used were made from commercially available fine grain graphite.

EXAMPLES 1 to 8

A mesophase pitch yarn having 2000 pitch fibers each with a diameter of about 13 microns was produced and thermoset in accordance with conventional practices. The thermoset yarn was collected onto a bobbin made from fine grain graphite and having an inside diameter of about 3 inch, a length of about 11 inch, and a carbon felt layer about ¼ inch thick. The bobbin had no end faces and the winding tension was about 150 g. A winding angle of about 20° was used. For each of the samples of the examples, the yarn collected was about 6000 feet in length and the pyrolyzing and carbonizing treatment was carried out in a nitrogen atmosphere with the temperature being raised at the rate of about 50° C. per hour until a temperature of 1300° C. was reached and this temperature was held for about two hours.

The temperature was returned to room temperature and the pyrolyzed yarn was then moved through a thread-line carbonizing unit which had an atmosphere of nitrogen and had a furnace temperature of about 2400° C. in order to further carbonize the yarn. The average line tension in the carbonizing unit was about 800 g.

The tensile strength and Young's modulus for each of the examples is given in Table 1.

TABLE 1

| Example | Tensile Strength PSI $\times 10^3$ | Young's Modulus PSI $\times 10^6$ |
|---|---|---|
| 1 | 315 | 51 |
| 2 | 303 | 53 |
| 3 | 308 | 58 |
| 4 | 307 | 58 |
| 5 | 300 | 57 |
| 6 | 308 | 57 |
| 7 | 315 | 57 |
| 8 | 310 | 58 |

The examples 1 to 8 resulted in carbon yarns which exhibited excellent mechanical properties and were visibly well collimated and substantially free of frays.

EXAMPLE 9

A mesophase pitch yarn such as in Example 1 was made and wound onto a bobbin having end faces but otherwise similar to the bobbin used in Example 1. Parallel winding with a tension of about 200 g was used. The heat treatment rate was the same as in Example 1 except that the final temperature was about 3000°. No thread-line treatment was used. The carbon yarn obtained had a tensile strength of about $400\times 10^3$ psi and a Young's modulus of greater than $100\times 10^6$ psi.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

What is claimed is:

1. A bobbin capable of retaining thermoset yarn during a heat treatment to pyrolyze and carbonize the thermoset yarn to produce a good quality carbon yarn, comprising a cylindrical body made of a material selected from the group consisting of stainless steel, refractory compounds and alloys, and graphite; and a layer of compressible resilient carbon material positioned on the outside surface of said cylindrical body to receive said thermoset yarn and to minimize stress between said cylindrical body and said thermoset yarn during said heat treatment.

2. The bobbin of claim 1, wherein said layer of compressible resilient carbon material is carbon felt.

3. The bobbin of claim 1, wherein said material is fine grain graphite.

4. The bobbin of claim 1, further comprising end faces provided on respective end portions of said cylindrical body in order to retain said thermoset yarn on said bobbin.

5. The bobbin of claim 2, wherein said carbon felt has a thickness of from about $\frac{1}{4}$ inch to about $\frac{1}{2}$ inch.

* * * * *